United States Patent [19]

Rudolph et al.

[11] Patent Number: 4,774,398

[45] Date of Patent: Sep. 27, 1988

[54] COUNTER

[75] Inventors: Achim J. Rudolph, Glastonbury; Arnold C. Johnson, West Hartford, both of Conn.

[73] Assignee: Western Pacific Industries Inc., New York, N.Y.

[21] Appl. No.: 116,487

[22] Filed: Nov. 2, 1987

[51] Int. Cl.[4] ..... G06C 5/02

[52] U.S. Cl. ..... 235/1 D; 235/117 R; 235/130 R; 235/139 R

[58] Field of Search ..... 235/1 A, 1 D, 1 C, 117 R, 235/130 R, 139 R, 95 R, 96

[56] References Cited

U.S. PATENT DOCUMENTS

| | | | |
|---|---|---|---|
| 1,919,493 | 7/1933 | Zubaty | 235/96 |
| 4,195,768 | 4/1980 | Herr et al. | 235/95 R X |
| 4,493,988 | 1/1985 | Ichimura | 235/96 |

*Primary Examiner*—B. R. Fuller

*Attorney, Agent, or Firm*—Chilton, Alix & Van Kirk

[57] ABSTRACT

A counter employs a barrel for rotatably mounting high order counter wheels and a shaft integrally extending from the barrel for mounting the lowest order counter wheel. The barrel forms a groove in which the transfer pinion assembly is located. The walls of the groove are engageable by the pinion assembly to limit skewing of the pinion assembly components. The lowest order wheel is snapped onto the shaft and secured in position by means of a semi-flexible mounting hub and cooperative shaft detents.

20 Claims, 5 Drawing Sheets

COUNTER

BACKGROUND OF THE INVENTION

This invention relates to counters which employ rotatable counter wheels. More particularly, the present invention relates to new and improved counters of highly efficient, inexpensive construction.

Counters which employ rotatable wheels having consecutive numerals on the peripheral outer surfaces of the wheels are well known. Such counters typically employ several counting wheels having consecutive numerals on their outer peripheral surfaces and transfer pinions between adjacent wheels for rotatably advancing the count of a succeeding number wheel in response to the rotatable advancement of a lower order wheel.

SUMMARY OF THE INVENTION

Briefly stated, the invention in a preferred form is a non-resettable, low cost counter which may be efficiently constructed from a relatively small number of plastic components. The counter comprises a lowest order counter wheel which is adapted to be rotatably driven and a multiplicity of higher order counter wheels. An axially extending barrel forms a segmental cylindrical surface which receives the counter wheels in axial side-by-side disposition to form a bank of coaxial rotatable wheels of increasing order. The barrel also defines an axially extending groove recessed from the cylindrical mounting surface and an end wall at one axial end of the groove. A pinion shaft integrally extends from the end wall and axially traverses the groove. Transfer pinions are mounted to the pinion shaft and engage between adjacent counter wheels for rotatably advancing a higher order wheel in response to pre-established angular rotation of the lower wheel. The transfer pinions each comprise a plurality of teeth having peripheral portions which are engageable against the portions of the barrel that define the groove so as to limit skewing of the pinion assembly to thereby maintain the transfer pinion assembly in a proper operative engagement with the counter wheels.

The higher order counter wheels comprise an integral, radially recessed driven gear and an integral driving gear. The gears are engageable with respective transfer pinions. A wheel mounting shaft integrally extends from the lower order end of the barrel. The lowest order counter wheel comprises a semi-flexible hub which is rotatably mounted to the mounting shaft. A pair of diametral detents project from the shaft. The lowest order counter wheel has a support panel which defines a pair of diametrically opposed recesses adjacent the hub so as to permit flexure in the hub. The hub may be mounted to the shaft by aligning the recesses and detents and axially forcing the lowest order wheel onto the mounting shaft. The barrel comprises integral stops which interact with the lowest order wheel to define the axial position thereof. A key shaft integrally axially extends from the barrel at an end opposite to the hub mounting shaft. The key shaft at an outer portion may have a square section for keying the barrel to a support frame.

The lowest order wheel in one embodiment further comprises a plurality of axially extending equiangular spaced drive pins. The transfer pinions are recessed action gears which drivably engage driven gears and are engaged by driving gears along a length of contact wherein most of the engagement contact occurs during the recess action interval of the contact length.

An object of the invention is to provide a new and improved counter of efficient and low cost construction.

Another object of the invention is to provide a new and improved counter which may be assembled in an efficient manner that is especially adaptable for automated assembling techniques.

A further object of the invention is to provide a new and improved counter of durable construction which operates in an efficient and reliable manner and is constructed of relatively few components.

A yet further object of the invention is to provide a new and improved counter which may be constructed of relatively inexpensively molded components and operates in an efficient manner with relatively low friction and is highly resistant to operational malfunction. Other objects and advantages of the invention will become apparent from the drawing and the specification.

DETAILED DESCRIPTION OF THE INVENTION

Figure 1:
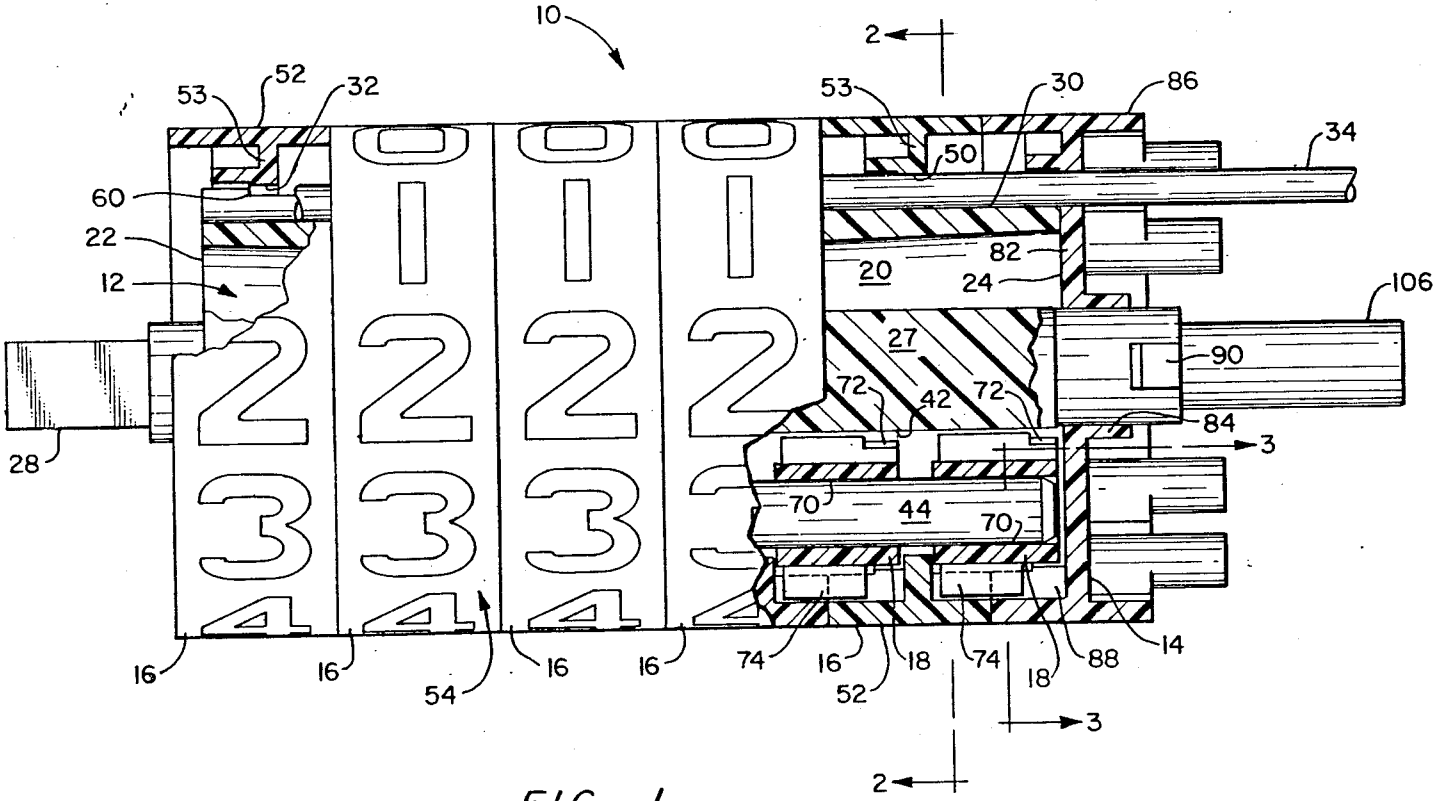
FIG. 1 is a front view, partly broken away and partly in section, of a counter in accordance with the present invention.

With reference to the drawings wherein like numerals represent like parts throughout the several figures, a counter in accordance with the present invention is generally designated by the numeral 10. Counter 10 is a non-resettable type counter having an efficient and inexpensive construction. The counter includes a unitary barrel unit 12 which provides the principal assembly mounting structure for the counter. A lowest order counter wheel 14 and five substantially identical high order wheels 16 are rotatably mounted to the barrel unit to form a bank of counter wheels of ascending order. Five substantially identical transfer pinions 18 which may be manufactured from the same mold are employed for transferring the count from lower order wheels to adjacent higher order wheels. The barrel unit 12, the counter wheels 14 and 16, and the pinions 18 are each molded plastic components. It will be appreciated that the invention is not limited to a specific number of counter wheels and pinions nor a specific component material.

Figure 6:
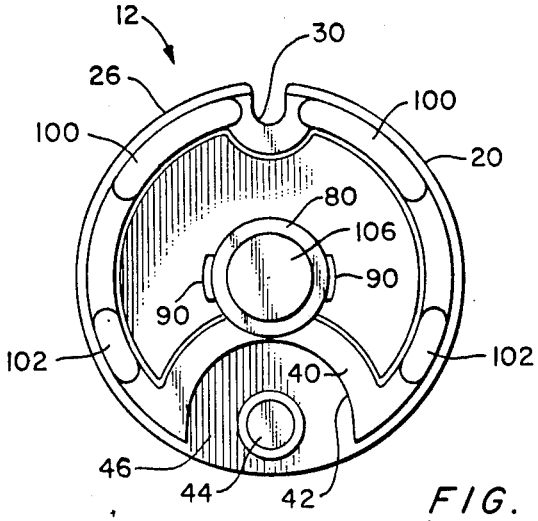
FIG. 6 is an end view of the counter of FIG. 1 viewed from the right thereof with the counter wheels being removed.
Figure 5:
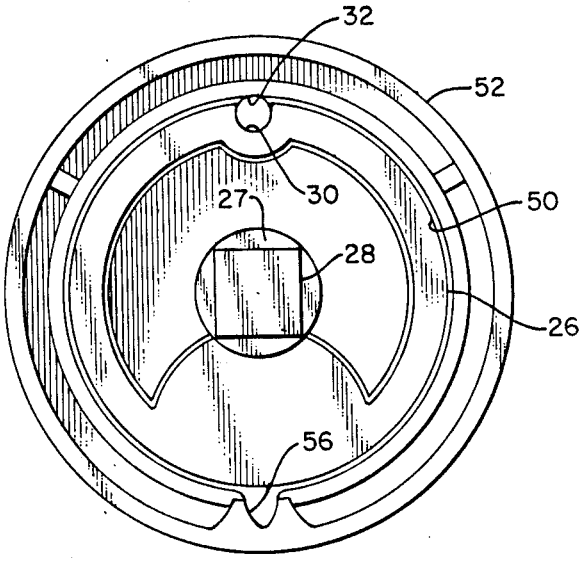
FIG. 5 is an end view of the counter of FIG. 1 viewed from the left thereof.
Figure 7:
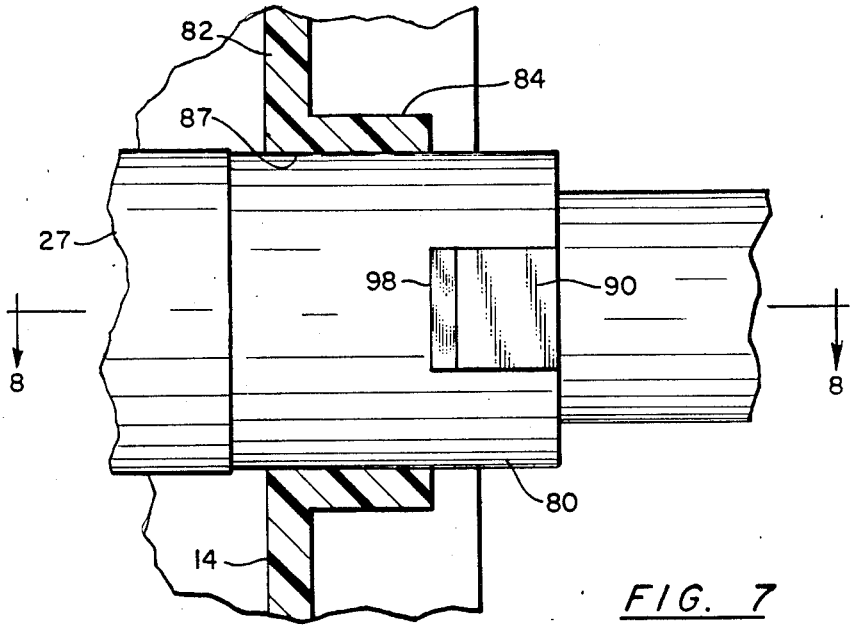
FIG. 7 is an enlarged fragmentary view, partly broken away, of the lowest order counter wheel mounting assembly of the counter of FIG. 1.
Figure 8:
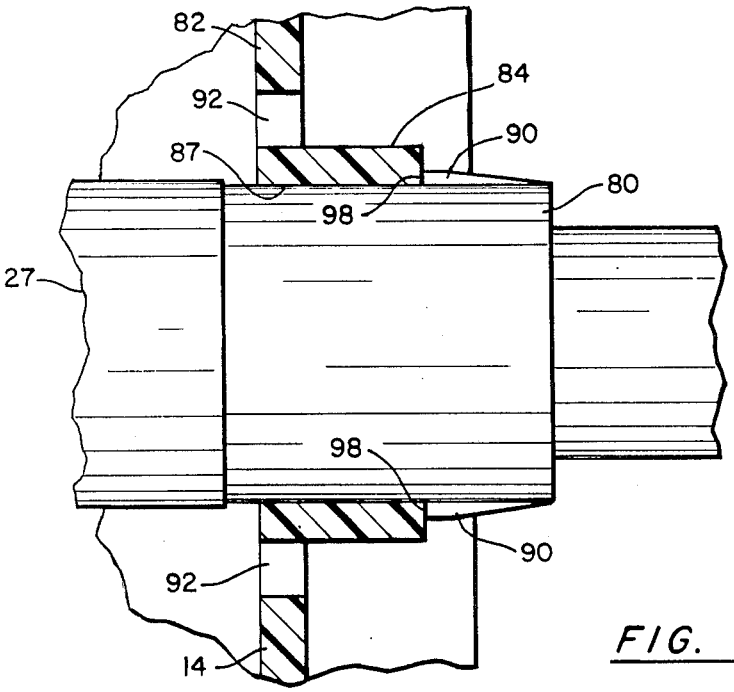
FIG. 8 is a sectional view of the counter assembly of FIG. 7 taken along the line 8—8 thereof.

With reference to FIGS. 1 and 6, the barrel unit 12 comprises a central axially extending barrel 20. Barrel 20 has an exterior segmental cylindrical surface 20 which extends from a higher order end 22 to a lower order end 24. The cylindrical barrel surface functions to rotatably mount the counter wheels 16. The high order wheels 16 are mounted in sequence in descending order by axially sliding the wheels over the barrel surface. A circumferential flange 26 (FIG. 5) at the high order end of the barrel engages the highest order wheel and functions as a reference and retaining stop for the counter wheel assembly.

A central support shaft 27 axially traverses the barrel and connects with the barrel via an intermediate transversely extending support plate (not illustrated). A key shaft 28 projects axially from the support shaft at the high order end of the barrel. The key shaft 28 has a square cross-section (or other suitable configuration) at the terminus so that the shaft may be keyed to a complementary aperture of a support frame (not illustrated) for mounting the barrel unit 12 in a fixed rotational relationship with the frame.

Figure 2:
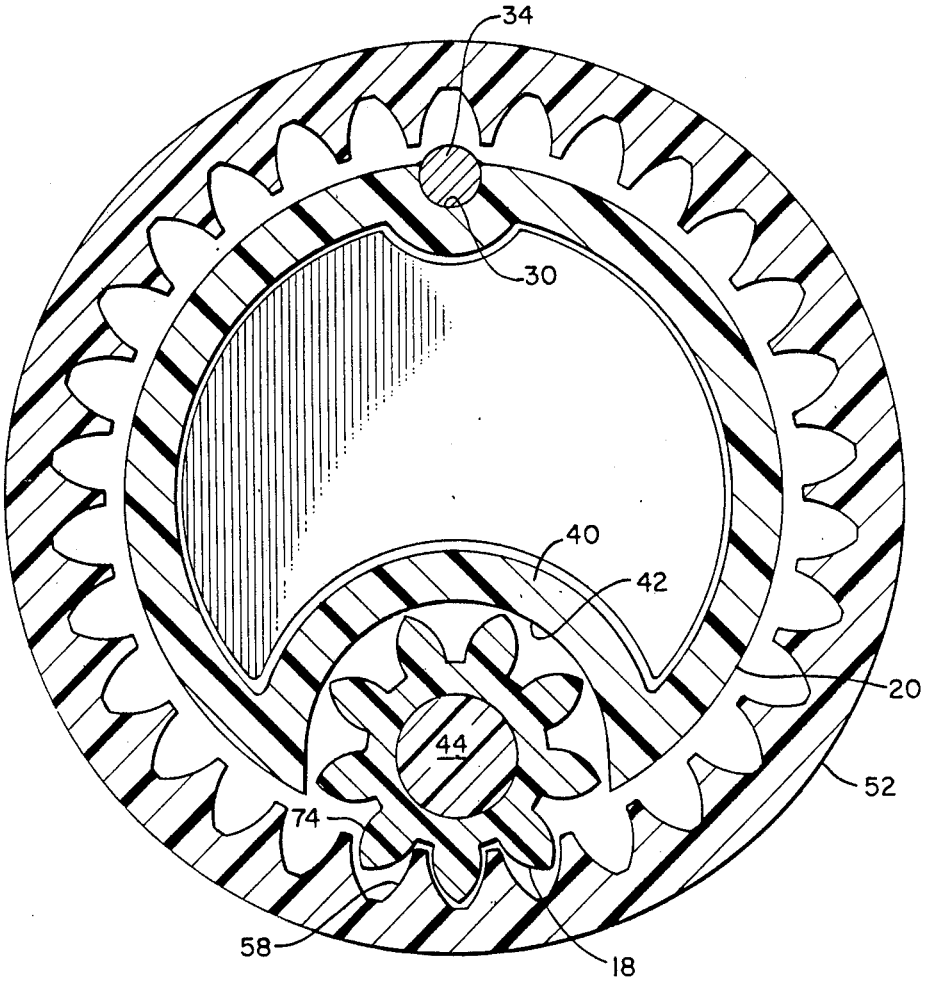
FIG. 2 is an enlarged sectional view taken along the line 2—2 of FIG. 1.

With additional reference to FIG. 2, an axially extending alignment slot 30 traverses the barrel. Each of the counter wheels 16 has an alignment notch or aperture 32 which is angularly alignable with the alignment slot 30. During assembly, the barrel is positioned so that an alignment pin 34 of the assembly fixture extends through the alignment slot 30. The counter wheels 16 are angularly positioned and mounted to the barrel so that the alignment pin 34 extends through the notches of the counter wheels to thereby properly index or angularly align the counter wheels. The assembled counter is removed or dismounted from the alignment pin 34 to permit operation of the counter.

A generally truncated U-shaped, recessed wall 40 is formed in the barrel at an angular location which is generally diametrically opposite the alignment slot 30. The wall 40 defines a trough or groove 42 which axially traverses the barrel from the high order end to the low order end. A pinion shaft 44 integrally extends from an end wall 46 (FIG. 6) at the high order end of the barrel and traverses the axial length of the groove. Pinion shaft 44 slidably mounts the pinions 18 in axial spaced relationship for rotatable engagement between adjacent counter wheels as will be detailed below.

The high order wheels 16 are coaxially aligned in side by side relationship and mounted for rotational movement on the barrel which essentially functions as a diametrically enlarged wheel supporting shaft. Each of the high order counter wheels 16 are substantially identical components which may be manufactured from the same mold. The counter wheels 16 are molded as single units which comprise a narrow inner mounting and bearing rim 50 and an outer peripheral rim 52 having suitable readout indicia 54 such as the consecutive numerals from 0 to 9. An annular support panel 53 integrally connects with rim 52 and extends radially inwardly to define the mounting rim 50. On the high order side of each counter wheel 16 is an integrally formed two tooth driving gear 56 (FIG. 5) which extends radially inwardly from the outer rim 52. The driving gear 56 is diametrically opposite the alignment slot 30 which is formed in the mounting rim 50. On the low order side of each counter wheel 16 is an integrally formed radially recessed, involuted driven gear 58 having thirty teeth.

The transfer pinions 18 are mounted to the pinion shaft 44 and are engageable between driving gears 56 and driven gears 58 of adjacent counter wheels for transferring the count from a lower order wheel to a higher order wheel. The transfer pinions 18 each have a central sleeve portion 70 which rotatably mounts on the pinion shaft 44. The sleeve portion 70 carries a plurality of alternating full and mutilated teeth 72 and 74, respectively, for providing the appropriate count transfer within the bank of counter wheels. The teeth 72 and 74 of the pinions extend radially from the pinion shaft a distance which is slightly less than corresponding distance from the pinion shaft to the groove defining wall 40. The clearance between wall 40 and the pinion teeth in one example ranges from 0.0015 to 0.0055 inches for a counter having a counter wheel diameter of approximately 0.740 inches. It will be appreciated that the pinions are received in the groove 42 and enclosed by the indicia rims 52 of adjacent counter wheels. In normal operation, the pinion teeth do not engage wall 40. However, the outer peripheral portions of the teeth are essentially engageable with the wall 40 to provide a support structure for the transfer pinion sub-assembly in the event that the pinion shaft warps or the pinions are skewed or transversely displaced during operation. Consequently, the wall 40 functions to maintain the pinion assembly in proper operational engagement with the counter wheels. The wall 40 essentially prevents the pinions from disengaging from the gearing of the counter wheels and thus helps to provide a counter which is tamper resistant.

The axial positioning of the pinions is determined by the cooperative engagement of the pinions axially with the integral driving and driven gears of adjacent counter wheels 16 (and counter wheel 14 for the lowest order transfer pinion). The radial or transverse positioning of the transfer pinions is defined by the pinion shaft 44 which may have some flexure characteristics and (if required) the cooperative engagement of the peripheral edges of the pinions 18 with the groove defining wall 40 of the barrel. The wall 40 thus functions as an auxiliary alignment trough to keep the transfer pinions in proper alignment and/or engagement relationship within the bank of counter wheels without the necessity of incorporating partition plates between the counter wheels.

In one embodiment of the invention, pinion shaft 44 is not employed. The axial positioning of the pinions 18 is determined by the cooperative engagement of the pinions with the integral driving and driven gears of adjacent counter wheels. The transverse positioning of the transfer pinion 18 is principally determined by the cooperative engagement of the peripheral edges of the pinions with the groove defining wall 40 of the barrel. The wall 40 and counter wheels thus function to compartmentalize the pinions in proper operative relationship within the barrel assembly.

The counter wheels 16 and the pinions 18 are mounted to the barrel unit 12 in alternating fashion. The highest order counter wheel 16 is axially slidably received by the barrel until the high order edge 60 of the mounting rim 50 engages flange 26. The assembly is accomplished with the notch 32 being engageably aligned with the alignment pin 34 which is maintained in place (as illustrated in FIG. 1) throughout the assembly process. A transfer pinion 18 is then mounted to the pinion shaft 44 and axially moved therealong until the high order end of the pinion teeth 74 engage the driven gear 58 of the counter wheel. The next highest order counter wheel is then slidably mounted to the barrel, suitably aligned by means of the alignment pin and axially displaced until the pinion teeth 72 of the highest order pinion engage the driving gear 56 of the next highest order counter wheel. The assembly process is essentially replicated for each of the high order counter wheels and transfer pinions with the axially alternating pinions being successively entirely enclosed by the outer indicia rims 52 of the respective counter wheels.

With additional reference to FIGS. 4, 6, 7 and 8, a wheel mounting shaft 80 integrally axially extends from the central support shaft 27 at the low order end of the barrel. Shaft 80 functions to rotatably mount the lowest order wheel 14. Wheel 14 includes a central medial panel 82 which radially extends between a mounting hub 84 and the outer indicia rim 86. The hub 84 has a resilient semi-flexible construction. The hub 84 defines an axial mounting aperture 87 which is substantially commensurate in diameter with the corresponding diameter of the shaft 80. A two tooth driving gear 88 (FIG. 1) extends radially inwardly from the indicia rim 86 at the high order side of the counter wheel 14.

Figure 4:
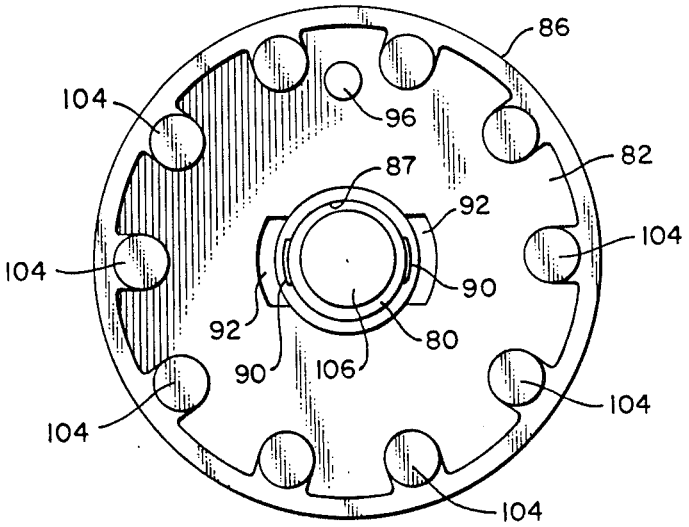
FIG. 4 is an end view of the counter of FIG. 1 viewed from the right thereof.

A pair of diametrically opposed, radial projections or detents 90 project from shaft 80. The detents 90 are ramp or cam-like structures which have transversely extending detaining edges 98 and are tapered so as to converge toward the outer end of the mounting shaft 80. A pair of diametrically opposed arcuate recesses 92 are formed in the panel 82 adjacent the hub 84. As best illustrated in FIG. 4, the angular extent of the recesses 92 exceeds the corresponding angular extent of the detents 90 to allow opposed portions of the hub to flex or deform outwardly. Upon angularly aligning the recesses with the detents and axially forcing the lowest order wheel 14 onto the mounting shaft 80, the hub 84 flexes sufficiently to ride over the detents 90. Upon the hub axially passing beyond the detent detaining edges 98 (to the left), the hub assumes its normal non-flexed state. The hub may be described as snapping into position against the detents to axially secure the lowest order counter wheel 14 to the barrel unit 12. The panel 82 also defines an alignment opening 96 for maintaining the proper indexing of the counter wheel during the assembly process. Once mounted, the lowest order counter wheel can not be easily dismounted from the barrel unit. Thus, the assembled counter is highly resistant to tampering.

The axial position of the lowest order counter wheel 14 is automatically defined by the detaining edges 98 of the detents 90 and arcuate segmented edges 100, 102 of the lower order end of the barrel. The segmented edges 100, 102 function as a stop which engages the surface of the panel 82 to limit the axial movement of the lowest order counter wheel toward the high order end of the counter. It will be appreciated that the lowest order wheel 14 is essentially snapped into place in a single assembly step which automatically fixes both the correct angular position and the correct axial position of the lowest order wheel. No additional end play adjustment of the counter wheels is required.

With additional reference to FIG. 4, a plurality of equiangularly spaced drive pins 104 axially integrally project from the lowest order wheel 14. The lowest order wheel 14 functions as the drive wheel for the bank of the counter wheels. The drive pins are adapted for engagement with a drive gear (not illustrated) for driving the counter. The drive gear may be mounted to reduced shaft extension 106 axially extending from shaft 80. The lowest order wheel 14 may employ other driven structures rather than the described drive pins 104. For example, face gears, helical gears, spur gears, etc. may also be employed. It should be appreciated that the key shaft 28 essentially fixes the angular relationship of the barrel with the principal mounting frame so that the counter wheels are rotatable about the barrel in response to a rotational drive applied to the lowest order counter wheel 14. Any axial load that may be applied to the counter at the lowest order counter wheel 14 is not transferred to the higher order wheels 16 and does not effect the end play of the counter wheels. A principal advantage of the foregoing described feature is that the drive system for the counter can have fewer parts and, hence, can be manufactured at a lower cost.

Figure 3:
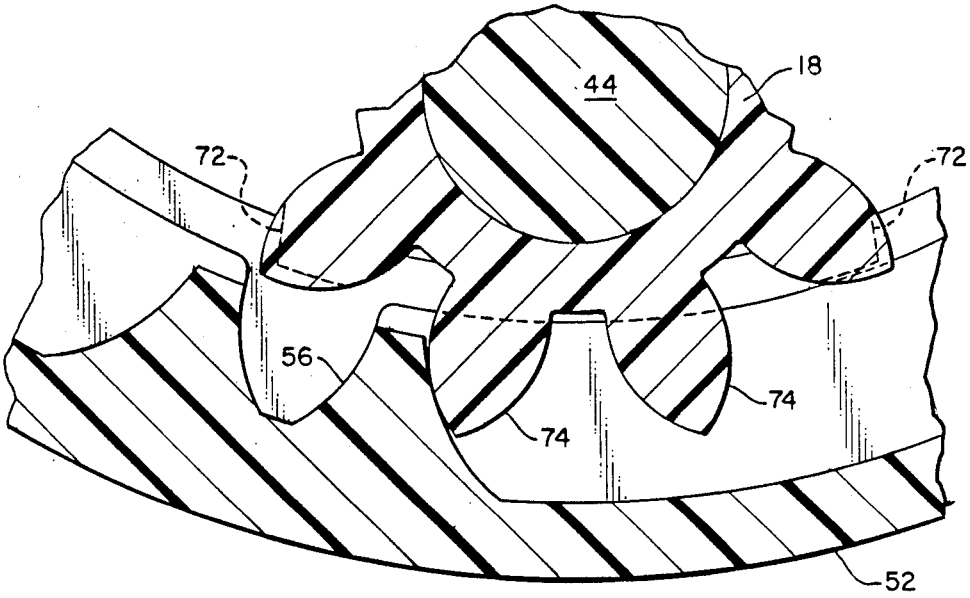
FIG. 3 is an enlarged fragmentary sectional view taken along the line 3—3 of FIG. 1.

In order that the frictional engagement between the transfer pinions and the driving and driven gears of the counter wheels be reduced, the gearing system of the counter is a full recess gear system as best illustrated in FIG. 3 or a semi-recess gear system rather than a standard involute gear system. In a standard involute gear system, the approach action exceeds the recess action interval along the length of contact of the gears. By incorporating a recess gear system, the majority of the engagement contact between the pinion 18 and the driving gear 56 as well as the contact between the pinion 18 and the driven gear 58 occurs during the recess portion or recess action interval of the length of contact between the gears and pinion. The application is particularly advantageous in counters such as disclosed. The friction during the recess action of gear engagement is on the order of half that during the approach action. The recess action is essentially a sliding out type action wherein the friction is lower and in a direction which aids the rotation. Consequently, the surface endurance limits of the molded gear structures and load capacity of the engaging pinion/counter wheel gears is enhanced.

Because the counter 10 does not require partition plates between the counter wheels, the counter wheels may have a wider construction and an enhanced contact area between the pinion teeth and counter wheel is provided. The wall 40 forms a trough which ensures that the pinions do not skew so as to result in an operational malfunction of the counter. The described counter is constructed from only four different components, e.g. a barrel unit I2, a lowest order counter wheel 14, high order counter wheels 16 and transfer pinions 18.

While a preferred embodiment of the foregoing invention has been set forth for purposes of illustration, the foregoing description should not be deemed a limitation of the invention herein. Accordingly, various modifications, adaptations and alternatives may occur to one skilled in the art without departing from the spirit and the scope of the present invention.

What is claimed:

1. A counter comprising:

a lowest order counter wheel adapted to be rotatably driven;

a plurality of high order counter wheels;

barrel means comprising an axially extending barrel for receiving said wheels to form a bank of coaxial rotatable counter wheels of increasing order, said barrel defining an axially extending groove and an end wall at one axial end of said groove;

a resilient pinion shaft integrally extending from said end wall and axially traversing said groove; and transfer means comprising a plurality of transfer pinions mounted to said pinion shaft for rotatably advancing a higher order wheel in response to a pre-established angular rotation of a lower order wheel, said transfer pinions each comprising a plurality of teeth having peripheral portions which are engageable against groove defining portions of said barrel to maintain said transfer means in proper operative position.

2. The counter of claim 1 wherein at least one of said high order counter wheels comprises a radially recessed driven gear and a driving gear, said at least one driven and driving gear being engageable with a respective transfer pinion.

3. The counter of claim 1 further comprising a wheel mounting shaft integrally extending from said barrel means, said lowest order counter wheel comprising a hub which is rotatably mounted to said mounting shaft.

4. The counter of claim 3 wherein a pair of diametrically opposed detents project from said shaft, said lowest order counter wheel comprising a panel which defines a pair of diametrically opposed recesses adjacent said hub, said hub and said recesses being cooperatively constructed to permit flexure in said hub so that said hub may be secured to said mounting shaft by aligning said recesses and detents and axially forcing said lowest order wheel onto said wheel shaft whereby the hub rides over the detents and the hub is axially engaged by said detents.

5. The counter of claim 3 wherein said barrel further comprises integral axially projecting limiting means engageable with said lowest order wheel to define the axial position thereof.

6. The counter of claim 1 further comprising a key shaft integrally axially extending from said barrel means.

7. The counter of claim 6 wherein said key shaft at an axial outer portion has a generally square transverse section.

8. The counter of claim 1 wherein said lowest order counter wheel comprises a hub rotatably mountable to said barrel means, said lowest order wheel further comprising a plurality of axially extending equiangularly spaced drive pins.

9. The counter of claim 2 wherein a said transfer pinion is a recessed action gear with a respective driving gear drivably engaging the said pinion along a length of contact comprising an approach action interval and a recess action interval wherein most of the engagement contact between the said pinion and driving gear occurs during the recess action interval.

10. The counter of claim 2 wherein a said transfer pinion is a recessed action gear which drivably engages the driven gear along a length of contact comprising an approach action interval and a recess action interval wherein most of the engagement contact between the said pinion and driven gear occurs during the recess action interval.

11. A counter comprising:

a lower order counter wheel comprising a mounting hub and flexure means for flexing a portion of said hub;

a plurality of high order counter wheels;

barrel means for slidably receiving said wheels to form a bank of coaxial rotatable counter wheels of increasing order;

transfer means engageable with said counter wheels for rotatably advancing a higher order wheel in response to a pre-established angular rotation of a lower order wheel;

said barrel means being a unitary member comprising an axially extending barrel for mounting said high order wheels and a shaft having detent means projecting therefrom for axially securing said hub to said shaft wherein said lowest order wheel is securably mountable to said shaft by mounting said hub onto said shaft and axially forcing said lowest order wheel so that said hub flexes and rides over said detent means to a position wherein the hub is axially engageable against said detent means.

12. The counter of claim 11 wherein said detent means comprises a pair of diametrically opposed projections.

13. The counter of claim 12 wherein said lowest order counter wheel comprises a panel extending from said hub, said flexure means comprises means defining a pair of diametrically opposed recesses in said panel.

14. The counter of claim 11 wherein said barrel comprises end portions which are engageable against the lowest order counter wheel to define in cooperation with said detent means the axial position of said lowest order wheel.

15. The counter of claim 11 wherein the barrel forms a segmental cylindrical surface for rotatably mounting said high order wheels and an axially extending groove recessed in relation to said cylindrical surface, said transfer means being located in said groove.

16. A counter comprising:

a lowest order counter wheel adapted to be rotatably driven;

a plurality of high order counter wheels;

barrel means comprising an axially extending barrel for receiving said wheels to form a bank of coaxial rotatable counter wheels of increasing order, said barrel defining an axially extending groove and an end wall at one axial end of said groove; and transfer means comprising a plurality of transfer pinions mounted in said groove for rotatably advancing a higher order wheel in response to a pre-established angular rotation of a lower order wheel, said transfer pinions each comprising a plurality of teeth having peripheral portions which are engageable against groove defining portions of said barrel to maintain said transfer means in proper operative position.

17. The counter of claim 16 wherein at least one of said high order counter wheels comprises a radially recessed driven gear and a driving gear, said at least one driven and driving gear being engageable with a respective transfer pinion.

18. The counter of claim 16 further comprising a wheel mounting shaft integrally extending from said barrel means, said lowest order counter wheel comprising a hub which is rotatably mounted to said mounting shaft.

19. The counter of claim 18 wherein a pair of diametrically opposed detents project from said shaft, said lowest order counter wheel comprising a panel which defines a pair of diametrically opposed recesses adjacent said hub, said hub and said recesses being cooperatively constructed to permit flexure in said hub so that said hub may be secured to said mounting shaft by aligning said recesses and detents and axially forcing said lowest order wheel onto said wheel shaft whereby the hub rides over the detents and the hub is axially engaged by said detents.

20. The counter of claim 18 further comprising stop means for limiting the axial movement of said hub.

* * * * *